United States Patent [19]

Giuliani

[11] Patent Number: 4,642,850

[45] Date of Patent: Feb. 17, 1987

[54] ROTATING CLEANER FOR COTTON AND WOOL CARD IN GENERAL

[76] Inventor: Marcello Giuliani, Cellerese n. 33, Campi Bisenzio, Firenze, Italy, 50013

[21] Appl. No.: 681,667

[22] Filed: Dec. 14, 1984

[30] Foreign Application Priority Data

Dec. 21, 1983 [IT] Italy ..... 9584 A/83

[51] Int. Cl.[4] ..... D01G 15/40

[52] U.S. Cl. ..... 19/105; 19/99; 19/100

[58] Field of Search ..... 19/105, 106 R, 108, 19/100, 101, 98, 99, 104

[56] References Cited

U.S. PATENT DOCUMENTS

| | | | |
|---|---|---|---|
| 1,564,600 | 12/1925 | Maly | 19/100 |
| 2,936,495 | 5/1960 | Taine et al. | 19/100 |
| 4,011,631 | 3/1977 | Estebanell | 19/100 |
| 4,129,924 | 12/1978 | Wirth | 19/99 |
| 4,524,492 | 6/1985 | Elliott | 19/105 |
| 4,527,307 | 7/1985 | Teichmann . | |

*Primary Examiner*—Werner H. Schroeder
*Assistant Examiner*—J. L. Olds
*Attorney, Agent, or Firm*—Hopgood, Calimafde, Kalil, Blaustein & Judlowe

[57] ABSTRACT

An improved cleaning device for textile fibres is provided comprising at least one carding drum and a taker-in cylinder or drum in tangential arrangement with a lower peripheral portion of the carding drum, the taker-in drum having cooperatively associated therewith means for feeding textile fibres thereto for subsequent delivery to the carding drum for further treatment thereof. The improvement resides in employing at least a pair of first and second cleaning cylinders tangentially located at a lower peripheral portion of the taker-in drum, the first cleaning cylinder being tangentially associated with the second cylinder. The rotation of the taker-in drum is such as to cause textile fibres fed thereto to pass as an outer layer around the first cleaning cylinder and from there to the second cleaning cylinder and then back to the taker-in drum for delivery to said carding drum, the speed of one of the cleaning cylinders relative to the other and to the taker-in drum being such as to remove particles therefrom by centrifugal force while returning workable fibres to the taker-in drum for delivery to the carding drum for further treatment.

7 Claims, 2 Drawing Figures

ROTATING CLEANER FOR COTTON AND WOOL CARD IN GENERAL

FIELD OF THE INVENTION

It is known in the art to use stationary or mobile members on carding drums in order to mix textile fibres, and/or produce fibres in elemental form. However, such members are not capable of cleaning the fibrous material worked upon to provide a useful product. Moreover, these members have drawbacks, well known in the art, such as breaking of fibres, pelletting and curliness, especially with regard to fine and short fibres. The use of such members do not assure acceptable cleaning in that fibres are discarded which are normally workable.

It is known to use fixed knives in the carding of cotton. While this method will reject a few impurities, it also rejects many fibres which are still workable. The method also causes pelletting and curliness, and also tends to cause the breaking of the fibres.

It is also known, in other cases, to add rotating cylinders which nevertheless do not accomplish any cleaning function, but only provide for mixing or diluting the web under work.

Further, it is known to use the so-called fixed flats, in contrast with the taker-in and/or the various rotating cylinders. However, these elements do not clean the fibrous material, but only provide a primary and partial straightening of the fibres.

Carding systems have been used involving a precard, generally called forecarriage, which, in the upper part of the carding cylinder, provides one or more pairs of working and doffing cylinders; these cylinders, although they accomplish mixing and carding functions, do not accomplish in practice the function of cleaning the fibrous material which is necessary in the carding process. In fact, since these pairs are mounted in the upper part of the carding cylinder, the dirty particles and the impurities which the doffer is able to remove from the web, fall down on the carding cylinder and are thus readmitted on the web being worked.

It is known in carding systems to use basins for collecting particles of dirty matter and fibrils aided by mechanical conveyors to take away the discard. The purpose of the basins is to prevent scrapings from falling onto the web. This arrangement causes complications, whereby the machine is apt to run dangerously and render the maintenance thereof costly and difficult. It is useful to point out that the position or location at which the doffing and working cylinders are mounted, does not allow the use of suitable devices for the purpose of facilitating the passage of the fibres between the cylinders in order to prevent the formation of pellets (usually called "neps") and curliness, or to avoid fibre breaking.

To provide for the lack of cleaning upon input and to obtain a clean web as desired, mobile flats are used above the cotton cards to provide for cleaning the web by separating and holding the impurities. However, together with the discard that they hold, they also hold a relevant percentage of useful fibres which are still workable. Also, the mobile flat unit requires the use of mechanical and/or pneumatic systems for detaching and removing the discard material. It should also be considered that the various flats which tend to load themselves with fibrils and dirty matter, lose their carding efficiency and, in some cases, may even create the so-called neps, while failing to suitably clean the web.

A further known solution is represented by the application of fixed plates, which sufficiently accomplish the fibres straightening function, but are not capable of removing the dirty matter, or even of discarding it. Accordingly, the fixed flats are used in practice preferably only for fibres that have already been cleaned.

SUMMARY OF THE INVENTION

The invention has as a main object the elimination of drawbacks of the existing system discussed hereinabove by effecting a cleaning of the fibrous material as to permit even the use of cards or carding drums without mobile flat units, thus avoiding the discarding of workable fibres, while discarding large and small impurities and fibrils as well and, in addition, avoid damage to useful fibres.

For the above purposes, according to the invention, a cleaning device is provided for textile material fed to cards of any type. The device includes a card or carding drum with a taker-in cylinder or drum associated tangentially therewith. Along the lower part of the periphery of said taker-in drum, which may have a clothing or cover, at least a pair or at least two pairs of cleaning cylinders are disposed, each being tangent to said periphery, as well as between them. The peripheral speeds employed are such that a first one of said cleaning cylinders draws the outer layer of fibres from the periphery of the taker-in drum and transfers it to the second one of said cleaning cylinders, from which the particles to be eliminated are projected by centrifugal force, while the workable fibrous material is transferred back to said taker-in drum which in turn passes the cleaned material to the carding drum.

According to the device of the invention, the first cleaning cylinder may be located down stream of the second cleaning cylinder in relation to the direction of the peripheral sliding or rotation of the taker-in cylinder.

In one embodiment of the device of the invention, a means is provided between the two cleaning cylinders comprising an operative separating and/or accompanying device or knife, grid, shield wall or the like to perform a complementary function.

Also, according to the invention, the two cleaning cylinders disposed tangentially to the taker-in drum may advantageously rotate in the opposite direction relative to the taker-in drum, the peripheral speed of the second cleaning cylinder being less than that of the taker-in cylinder and greater than that of the first cleaning cylinder.

A device as herein defined may be advantageously associated with means for the removal of discards, which can be done pneumatically, mechanically or manually.

BRIEF DESCRIPTION OF THE DRAWINGS

The invention will be better understood from the following description taken in conjunction with the accompanying drawing which shows a practical non limitative exemplification of the invention itself. In the drawing.

DESCRIPTION OF THE PREFERRED EMBODIMENTS

Figure 1:
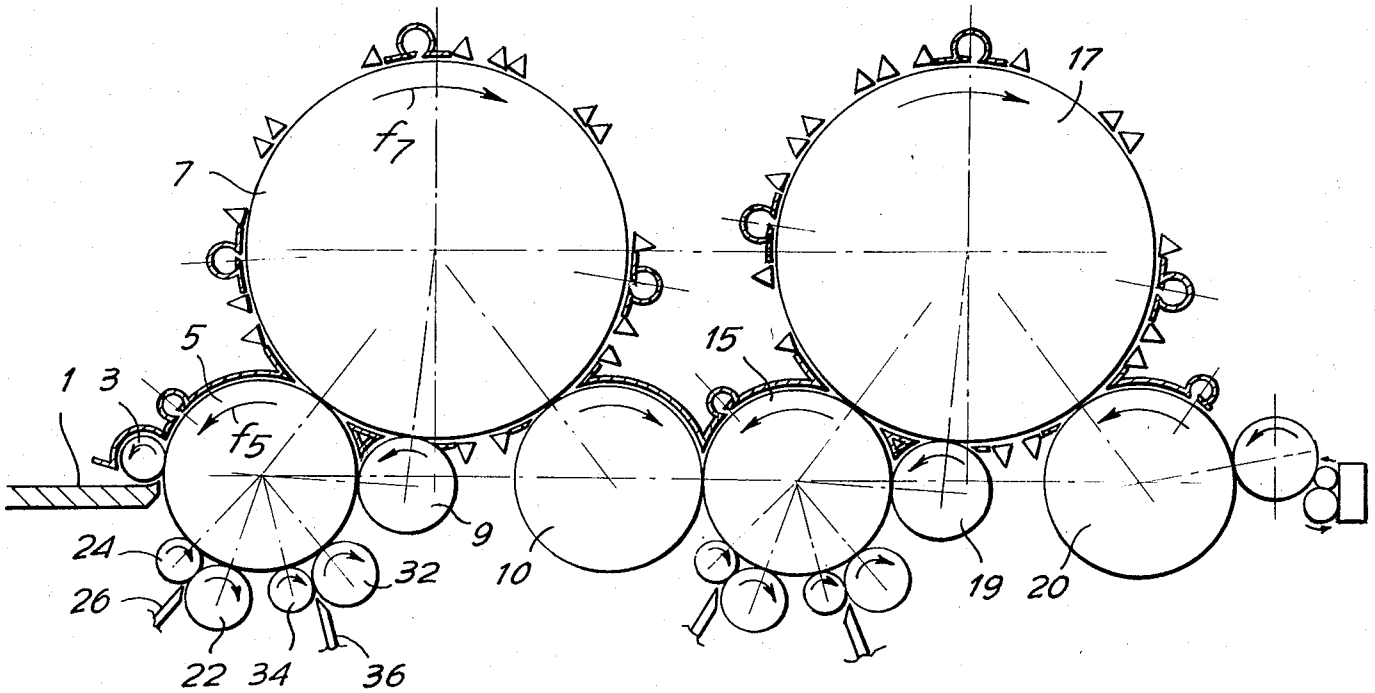
FIGS. 1 and 2 show diagrammatically a card with carding rods, as an example among the cards to which the invention may be applied, and an enlarged detail.
Figure 2:
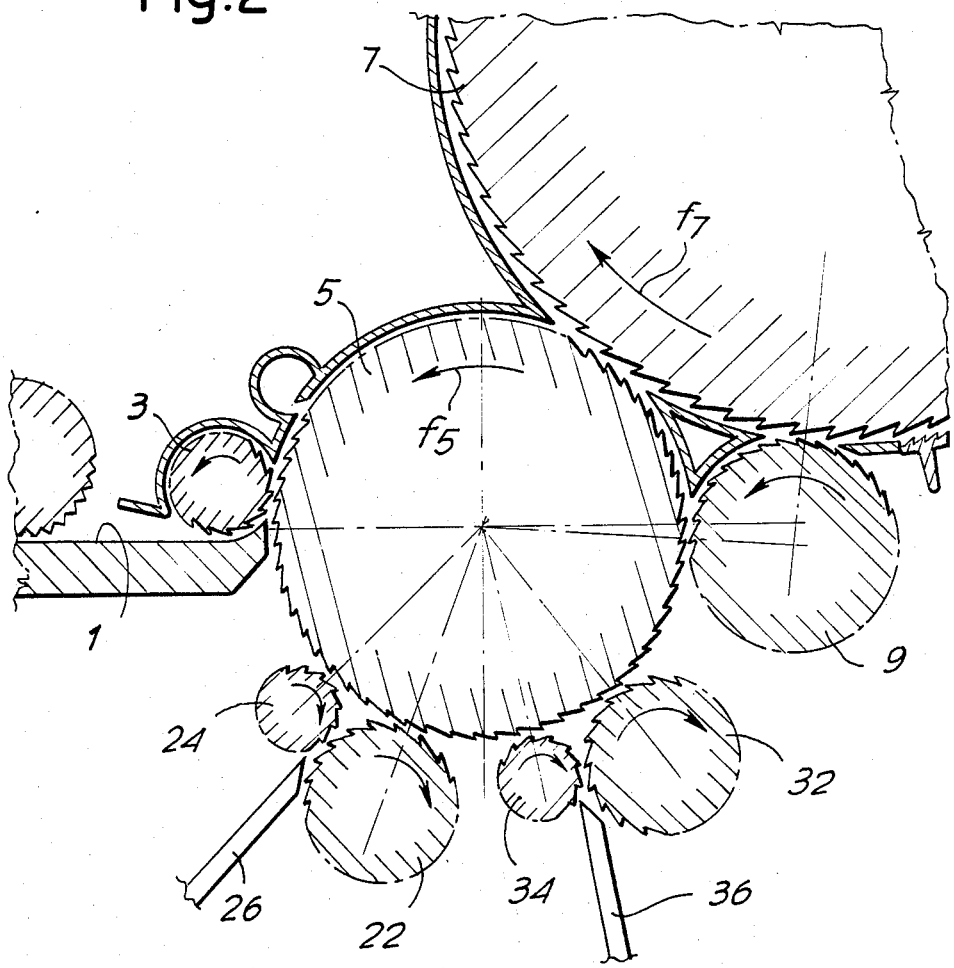

In the drawing, numeral 1 indicates a feeding means or surface for cooperating with a feeding auxiliary drum 3, all constituting a feeding arrangement comprising a taker-in cylinder 5 which rotates in the direction of arrow f5 to load the barrel with fibres or carding drum 7 rotating in the direction of arrow f7. At the upper part of drum 7, typical members for cards or carding drums may be provided, among which include working cylinders, carding rods, etc. Relative to both cylinder 5 and drum 7 a shaver cylinder 9 is tangentially associated of known type. Down-stream of carding drum 7 a further arrangement may be provided, similar to the preceding one, with a discharging cylinder 10 and corresponding members 15, 17, 19, 20 which are analogous to 5, 7, 9, 10.

In order to simplify the description, only the first unit need be discussed.

According to the invention, below the taker-in drum 5 one or more cleaning groups are provided, each group comprising a cleaning cylinder 22 of greater diameter and a cleaning cylinder 24 of smaller diameter, disposed as illustrated, with the clothings conventionally, inclined and tangent between them and also with the taker-in drum. The cylinder 24 has a peripheral speed which is less than that of the taker-in drum 5 and greater than that of cylinder 22, the peripheral speed of cylinder 22 being less than the peripheral speed, of taker-in drum 5.

As indicated by numerals 32 and 34, there is a second cleaning group analogous to the preceding one.

Numerals 26 and 36 indicate knife-like separators and companions located between the cylinders 22, 24 and 32, 34.

To accomplish the object of the invention, a pair of rotating cleaners is provided below taker-in drum 5 which operates in contrast and in cooperation with said taker-in drum. This pair of rotating cleaning cylinders 22, 24 (and 32, 34 etc.) has cylinders of different diameters, which rotate in the direction opposite to the rotation direction of taker-in drum 5, with the above specified peripheral speeds.

Referring by way of example to cleaning cylinders 22, 24, the cylinder 22 having greater diameter rotates at a low velocity and takes away the upper layer of the web from the taker-in drum 5. The web upper layer, owing to the centrifugal force generated by taker-in drum 5 itself, holds the impurities, the unworkable fibrils and all which is technologically detrimental to the subsequent spinning passages. The cylinder 24, having a smaller diameter and a higher rotational speed, removes from cylinder 22 having a greater diameter, all the material it had been loaded with. During rotation, owing to the centrifugal force which it generates, cylinder 24 separates, by projecting them outside, that is, downwards, all the impurities and the workable fibrils, while retaining, instead, all the workable fibres which are transferred again from the cylinder 24 to the taker-in drum 5.

The position into which the pair or pairs of cylinders 22, 24 and/or 32, 34 are located allows also for the provision of further separating and/or accompanying elements or devices, like the ones indicated by 26 or 36, to facilitate the passage of the fibres between the various cylinders so that the cylinder with smaller diameter 24 or 34 will doff the cylinder with larger diameter 22 or 32 by rendering the fibres elemental so that the subsequent service on the taker-in drum 5 is accomplished with absolute regularity and uniformity with a consequent facilitated cleaning.

Without such devices 26 or 36 as mentioned (or equivalent) the faster cylinder having smaller diameter would doff the less fast cylinder having a larger diameter and remove the material in tufts or bunches and cause in the taker-in drum 5 service a tendency for fibres to break in addition to irregular curlings and thus the formation of neps.

The above described cleaning device is efficient and may be used in different ways and with some suitable applications for all carding of textile fibres, either fresh or regenerated, vegetal, animal or chemical, individual or mixed, thus providing a cleaning system with less problems, while avoiding discarding of workable fibres, as occurs in industry.

The action developed by the pair or pairs of cleaning cylinders referred to by numerals 22, 24 or 32, 34 improves the efficiency of all the machines located downstream of the carding unit, thus avoiding the interruptions caused by impurities which when present would cause breaking of threads and/or stopping of machines or of production trains.

A cleaning device as herein described may be applied to all carding devices in general, with the possibility of different rotational speeds and in the direction of rotation of the cylinders, while having the above specified functions. For each taker-in drum only one pair or more pairs of cleaning cylinders may be provided. Either only one or more pairs of cylinders may be mounted per each card unit or in tandem and/or on cards inserted in the carding assortments.

With a cleaning group as described above, pneumatic and/or mechanical means may be associated capable of automatically and/or with manual intervention of removing the discard separated by them from the material being worked. With cleaning groups like the 22, 24 or 32, 34 groups knives, grids, shields or the like may be combined, working in cooperation or in contrast with the cleaning cylinders.

It will be appreciated that the drawing is merely an example of one embodiment that may be employed in carrying out the invention. The invention may vary in form without departing from the spirit and scope thereof.

I claim:

1. In a cleaning device for textile fibres comprising at least one carding drum and a taker-in cylinder or drum in tangential arrangement with a lower peripheral portion of said carding drum, said taker-in drum having cooperatively associated therewith means for feeding textile fibres thereto for subsequent delivery to said carding drum for further treatment thereof, the improvement which comprises:

at least a pair of cleaning cylinders located at a lower peripheral portion of said taker-in drum and tangential thereto, one of said cleaning cylinders being tangentially associated with said other cleaning cylinder, the rotation of said taker-in drum being such as to cause textile fibres fed thereto to pass around said drum and provide an outer layer thereof for transfer to one of said cleaning cylinders and from there to the other cleaning cylinder and then back to said taker-in drum for delivery to said carding drum, the speed of rotation of one of said cleaning cylinders containing the outer layer relative to the speed of the other cylinder and to the speed of said taker-in drum being such as to remove particles therefrom by centrifugal force while returning workable fibres to said taker-in drum for delivery to said carding drum for further treatment.

2. The cleaning device of claim 1, wherein said pair of cleaning cylinders include first and second cylinders, and wherein said first cleaning cylinder is located down-stream of said second cleaning cylinder in the direction of rotation of said taker-in drum.

3. The cleaning device of claim 2, wherein a means is provided between the first and second cleaning cylinders to facilitate the passage of fibres between said cleaning cylinders.

4. The cleaning device of claim 3, wherein the direction of rotation of each of said cleaning cylinders is opposite to that of the taker-in drum, the peripheral speed of the second cleaning cylinder being less than the peripheral speed of the taker-in drum and greater than that of the first cleaning cylinder.

5. In a cleaning device for textile fibres comprising at least one carding drum and a taker-in cylinder or drum in tangential arrangement with a lower peripheral portion of said carding drum, said taker-in drum having cooperatively associated therewith means for feeding textile fibres thereto for subsequent delivery to said carding drum for further treatment thereof, the improvement which comprises:

at least a pair of first and second cleaning cylinders located at a lower peripheral portion of said taker-in drum and tangential thereto, the first cleaning cylinder being tangentially associated with said second cylinder, said first cleaning cylinder being disposed downstream of said second cleaning cylinder relative to the direction of rotation of said taker-in drum, the rotation of said taker-in drum being such as to cause textile fibres fed thereto to pass around said drum and provide an outer layer thereof which is transferred to said first cleaning cylinder and from there to said second cleaning cylinder and then back to said taker-in drum for delivery to said carding drum, the speed of said first cylinder relative to said second cylinder and to said taker-in drum being such as to remove particles therefrom by centrifugal force while returning workable fibres to said taker-in drum for delivery to said carding drum for further treatment.

6. The cleaning device of claim 5, wherein a means is provided between the first and second cleaning cylinders to facilitate the passage of fibres between said cylinders.

7. The cleaning device of claim 5, wherein the direction of rotation of said cleaning cylinders is opposite to that of the taker-in cylinder, the peripheral speed of the second cleaning cylinder being less than the peripheral speed of the taker-in cylinder and greater than that of the first cleaning cylinder.

* * * * *